US006799632B2

(12) United States Patent
Hall et al.

(10) Patent No.: US 6,799,632 B2
(45) Date of Patent: Oct. 5, 2004

(54) EXPANDABLE METAL LINER FOR DOWNHOLE COMPONENTS

(75) Inventors: David R. Hall, Provo, UT (US); Joe R. Fox, Provo, UT (US)

(73) Assignee: Intelliserv, Inc., Provo, UT (US)

( * ) Notice: Subject to any disclaimer, the term of this patent is extended or adjusted under 35 U.S.C. 154(b) by 17 days.

(21) Appl. No.: 10/212,187

(22) Filed: Aug. 5, 2002

(65) Prior Publication Data

US 2004/0020659 A1 Feb. 5, 2004

(51) Int. Cl.[7] ..... E21B 43/10
(52) U.S. Cl. ..... 166/207; 166/212; 166/242.2
(58) Field of Search ..... 166/120, 206, 166/207, 212, 217, 242.2, 380, 277

(56) References Cited

U.S. PATENT DOCUMENTS

| | | | |
|---|---|---|---|
| 749,633 | A | 1/1904 | Seeley |
| 2,178,931 | A | 11/1939 | Crites et al. |
| 2,301,783 | A | 11/1942 | Lee |
| 2,354,887 | A | 8/1944 | Silverman et al. |
| 2,379,800 | A | 7/1945 | Hare |
| 2,414,719 | A | 1/1947 | Cloud |
| 2,633,414 | A | 3/1953 | Boivinet |
| 2,659,773 | A | 11/1953 | Barney |
| 2,662,123 | A | 12/1953 | Koenig, Jr. |
| 2,974,303 | A | 3/1961 | Dixon |
| 2,982,360 | A | 5/1961 | Morton et al. |
| 3,079,549 | A | 2/1963 | Martin |
| 3,090,031 | A | 5/1963 | Lord |
| 3,186,222 | A | 6/1965 | Martin |
| 3,194,886 | A | 7/1965 | Mason |
| 3,209,323 | A | 9/1965 | Grossman, Jr. |
| 3,227,973 | A | 1/1966 | Gray |
| 3,518,608 | A | 6/1970 | Papadopoulos |
| 3,696,332 | A | 10/1972 | Dickson, Jr. et al. |
| 3,793,632 | A | 2/1974 | Still |
| 3,807,502 | A | 4/1974 | Heilhecker et al. |
| 3,879,097 | A | 4/1975 | Oertle |
| 3,930,220 | A | 12/1975 | Shawhan |
| 3,957,118 | A | 5/1976 | Barry et al. |
| 3,989,330 | A | 11/1976 | Cullen et al. |
| 4,012,092 | A | 3/1977 | Godbey |
| 4,087,781 | A | 5/1978 | Grossi et al. |
| 4,095,865 | A | 6/1978 | Denison et al. |
| 4,121,193 | A | 10/1978 | Denison |
| 4,126,848 | A | 11/1978 | Denison |
| 4,215,426 | A | 7/1980 | Klatt |
| 4,220,381 | A | 9/1980 | Van der Graaf |

(List continued on next page.)

*Primary Examiner*—Zakiya Walker
(74) *Attorney, Agent, or Firm*—Jeffery E. Daly

(57) ABSTRACT

A liner for an annular downhole component is comprised of an expandable metal tube having indentations along its surface. The indentations are formed in the wall of the tube either by drawing the tube through a die, by hydroforming, by stamping, or roll forming and may extend axially, radially, or spirally along its wall. The indentations accommodate radial and axial expansion of the tube within the downhole component. The tube is inserted into the annular component and deformed to match an inside surface of the component. The tube may be expanded using a hydroforming process or by drawing a mandrel through the tube. The tube may be expanded in such a manner so as to place it in compression against the inside wall of the component. The tube is useful for improving component hydraulics, shielding components from contamination, inhibiting corrosion, and preventing wear to the downhole component during use. It may also be useful for positioning conduit and insulated conductors within the component. An insulating material may be disposed between the tube and the component in order to prevent galvanic corrosion of the downhole component.

19 Claims, 10 Drawing Sheets

U.S. PATENT DOCUMENTS 4,348,672 A 9/1982 Givler
4,445,734 A 5/1984 Cunningham
4,537,457 A 8/1985 Davis, Jr. et al.
4,578,675 A 3/1986 Macleod
4,605,268 A 8/1986 Meador
4,660,910 A 4/1987 Sharp et al.
4,683,944 A 8/1987 Curlett
4,698,631 A 10/1987 Kelly, Jr. et al.
4,722,402 A 2/1988 Weldon
4,785,247 A 11/1988 Meador et al.
4,788,544 A 11/1988 Howard
4,806,928 A 2/1989 Veneruso
4,865,127 A * 9/1989 Koster ..... 166/277
4,884,071 A 11/1989 Howard
4,901,069 A 2/1990 Veneruso
4,914,433 A 4/1990 Galle
4,924,949 A 5/1990 Curlett
5,008,664 A 4/1991 More et al.
5,052,941 A 10/1991 Hernandez-Marti et al.
5,148,408 A 9/1992 Matthews
5,248,857 A 9/1993 Ollivier
5,278,550 A 1/1994 Rhein-Knudsen et al.
5,302,138 A 4/1994 Shields
5,311,661 A 5/1994 Zifferer
5,332,049 A 7/1994 Tew
5,334,801 A 8/1994 Mohn
5,371,496 A 12/1994 Tanamachi
5,390,742 A * 2/1995 Dines et al. ..... 166/297
5,454,605 A 10/1995 Mott
5,455,573 A 10/1995 Delatorre
5,505,502 A 4/1996 Smith et al.
5,517,843 A 5/1996 Winship
5,521,592 A 5/1996 Veneruso
5,568,448 A 10/1996 Tanigushi et al.
5,650,983 A 7/1997 Kondo et al.
5,691,712 A 11/1997 Meek et al.
5,743,301 A 4/1998 Winship
RE35,790 E 5/1998 Pustanyk et al.
5,810,401 A 9/1998 Mosing et al.
5,833,490 A 11/1998 Bouldin
5,853,199 A 12/1998 Wilson
5,856,710 A 1/1999 Baughman et al.
5,898,408 A 4/1999 Du
5,908,212 A 6/1999 Smith et al.
5,924,499 A 7/1999 Birchak et al.
5,942,990 A 8/1999 Smith et al.
5,955,966 A 9/1999 Jeffryes et al.
5,959,547 A 9/1999 Tubel et al.
5,971,072 A 10/1999 Huber et al.
6,030,004 A 2/2000 Schock et al.
6,041,872 A 3/2000 Holcomb
6,045,165 A 4/2000 Sugino et al.
6,046,685 A 4/2000 Tubel
6,057,784 A 5/2000 Schaaf et al.
6,104,707 A 8/2000 Abraham
6,108,268 A 8/2000 Moss
6,123,561 A 9/2000 Turner et al.
6,141,763 A 10/2000 Smith et al.
6,173,334 B1 1/2001 Matsuzaki et al.
6,177,882 B1 1/2001 Ringgenberg et al.
6,188,223 B1 2/2001 van Steenwyk et al.
6,196,335 B1 3/2001 Rodney
6,223,826 B1 5/2001 Chau et al.
6,354,373 B1 * 3/2002 Vercaemer et al. ..... 166/277
6,367,565 B1 4/2002 Hall
6,392,317 B1 5/2002 Hall et al.
2002/0135179 A1 9/2002 Boyle et al.
2002/0193004 A1 12/2002 Boyle et al.
2003/0070842 A1 4/2003 Bailey et al.
2003/0106688 A1 * 6/2003 Saugier ..... 166/277
2003/0178197 A1 * 9/2003 Smith et al. ..... 166/313

* cited by examiner

EXPANDABLE METAL LINER FOR DOWNHOLE COMPONENTS

This invention was made with government support under Contract No. DE-FC26-97FT343656 awarded by the U.S. Department of Energy. The government has certain rights the invention.

RELATED APPLICATIONS

None

BACKGROUND OF THE INVENTION

This invention relates to a liner for downhole components. Specifically, this invention is a metal tube having its original uniform shape sufficiently modified by the formation of non-uniform alterations to its shape so that it can be inserted into the bore of a downhole component and then expanded to conform to the interior surface of the downhole component. The shape modifications allow the tube to be expanded beyond its original diameter without rupturing the tube. The application of this invention is useful for any annular component in a production well or a drill string for drilling oil, gas, geothermal wells, or other subterranean excavations.

Provision of a liner in a drill pipe or other downhole component, including well casing, for the purpose of improving the corrosion resistance of the drill pipe or casing and for providing a passageway for electrical conductors and fluid flow is known in the art, as taught by the following references. U.S. Pat. No. 2,379,800, to Hare, incorporated herein by this reference, discloses the use of a protective shield for conductors and coils running along the length of the drill pipe. The shield serves to protect the conductors from abrasion that would be caused by the drilling fluid and other materials passing through the bore of the drill pipe.

U.S. Pat. No. 2,633,414, to Boivinet, incorporated herein by this reference, discloses a liner for an autoclave having folds that allows the liner to be installed into the autoclave. Once the liner is installed, it is expanded against the inside wall of the autoclave using hydraulic pressure.

U.S. Pat. No. 4,012,092, to Godbey, incorporated herein by this reference, discloses an electrical transmission system in a drill string using electrically conductive pipe insulated with a complementary sheath of elastic dielectric liner material. In order to ensure adequate electrical insulation at the ends of each tube, the sheath was slightly longer than its mating tube. The elastic nature of the sheath material enabled it to conform to the geometry of the drill pipe and its joint.

U.S. Pat. No. 2,982,360, to Morton et al., incorporated herein by this reference, discloses a liner for a well casing in a sour well, e.g. a well where hydrogen cracking and embrittlement are believed to be the cause of stress corrosion and failure of metal the well casing. The objective of the disclosure is to provide a liner to protect the casing and other downhole components from the effects of corrosion. A unique feature of this disclosure is that the liner is not bonded to the downhole component, in order to provide some void space between the liner and the component wall. However, it does teach that the metal liner can be expanded against the inside wall of the casing using mechanical or hydraulic pressure.

U.S. Pat. No. 4,095,865, to Denison et al., incorporated herein by this reference, discloses an improved drill pipe for sending an electrical signal along the drill string. The improvement comprises placing the conductor wire in a spiral conduit that is sprung against the inside bore wall of the pipe. The conduit serves to protect the conductor and provides an annular space within the bore for the passage of drilling tools.

U.S. Pat. No. 4,445,734, to Cunningham, incorporated herein by this reference, teaches an electrical conductor or wire segment imbedded within the wall of the liner, which secures the conductor to the pipe wall and protects the conductor from abrasion and contamination caused by the circulating drilling fluid. The liner of the reference is composed of an elastomeric, dielectric material that is bonded to the inner wall of the drill pipe.

U.S. Pat. No. 4,924,949, to Curlett, incorporated herein by this reference, discloses a system of conduits along the pipe wall. The conduits are useful for conveying electrical conductors and fluids to and from the surface during the drilling operation.

U.S. Pat. No. 5,311,661, to Zifferer, incorporated herein by this reference, teaches a method for forming corrugations in the wall of a copper tube. The corrugations are formed by drawing or pushing the tube through a system of dies to reduce the diameter of the end portions and form the corrugations in center portion. Although the disclosure does not anticipate the use of a corrugated liner in drill pipe or other downhole component, the method of forming the corrugations is readily adaptable for that purpose.

U.S. Pat. No. 5,517,843, to Winship, incorporated herein by this reference, discloses a method of making an upset end on metal pipe. The method of the reference teaches that as the end of the metal tube is forged, i.e. upset, the wall thickness of the end of the pipe increases and inside diameter of the pipe is reduced.

An object of the present invention, which is not disclosed or anticipated by the prior art, is to provide a liner that can be adapted for insertion into a downhole component and can accommodate the regular and varying inside diameters found in downhole components. An additional object of the invention is to provide a liner capable of withstanding the dynamic forces and corrosive and abrasive environment associated with drilling and production of oil, gas, geothermal resources, and subterranean excavation.

SUMMARY OF THE INVENTION

This invention discloses a liner for downhole annular components comprising an expandable metal tube suitable for conforming to an inside surface of the downhole component, wherein the downhole component may be uniform or non-uniform in cross section and/or material properties. The tube may be formed outside the downhole component and then inserted into the component, or it could be expanded and formed after being inserted into the component. In order to accommodate expansion of the tube and conformity with the interior of the downhole component, the tube is preformed with any of a variety of shape modifications comprising convolutions, corrugations, indentations, and dimples that generally increase the circumferential area of the tube and facilitate expansion of the tube to a desired shape. The metal tube may have generally a circular, square, rectangular, oval, or conic cross section, and the outer surface that interfaces with the inner surface of the downhole component may be polished, roughened, knurled, or coated with an insulating material. Depending on the desired application, the tube may be formed with sufficient force inside the component that it remains in compression against the inside surface wall of the component, or it may be expanded to a lesser diameter. For example, in some cases it may be desirable to expand the tube so that it merely contacts the inside wall of the component, or it may be desirable that the tube be expanded to a diameter that provides an annulus, or other space, between the tube and inside surface of the component. Where an annulus is provided, additional equipment such as pumps, valves, springs, filters, batteries, and electronic circuitry may be installed between the tube and the inside wall of the component. The tube also may be formed over one or more electrical or fiber optic conductors or conduits in order to provide protective passageways for these components.

DETAILED DESCRIPTION OF THE INVENTION

Generally, downhole components are constrained within an annular geometry and capable of being connected to each other at designated locations along the drill string or along the well casing of an oil, gas, or geothermal well. Downhole components include drill pipe, drill collars, heavy weight drill pipe, casing, reamers, jars, shock absorbers, bit boxes, electronic subs, packers, bent subs, perforators, hydraulic motors, turbines, generators, pumps, down-hole assemblies, and batteries. The annular configuration of the components in a drill string is necessary in order to accommodate the flow of drilling fluid to the bit and for the insertion of well logging equipment and other tools into the borehole. In a production well, the annular components enable the flow of oil and gas to the surface and provide means for installing pumps, sensors, and other equipment into the producing well. One of the objectives of this invention, therefore, is to provide a liner that is capable of accommodating the various interior surfaces of the annular downhole components. The liner of this invention is useful for improving the hydraulics of fluid flow through the component, for increasing the component's resistance to corrosion, and for securing other sub-assemblies and equipment inside the downhole component.

Since downhole components share the annular geometry of a drill pipe, the detailed description of this invention will be directed to a liner within that downhole component. However, those skilled in the art will immediately recognize the application of this invention to the other downhole components that make up the drill string or production tubing in a well.

Figure 1:
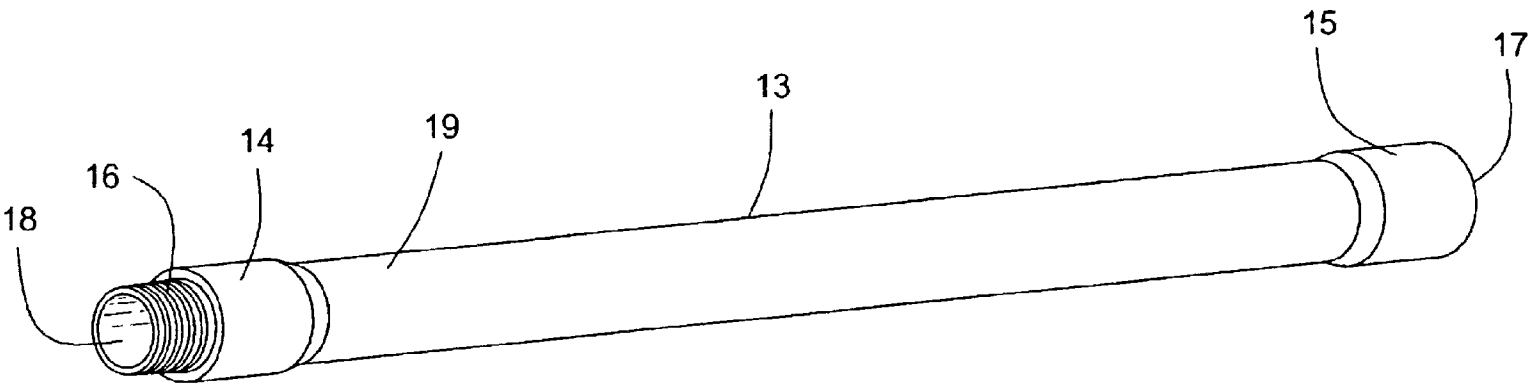
FIG. 1 is a perspective representation of a downhole component.

FIG. 1 is a perspective representation of a length of drill pipe (13) having a pin end tool joint (14) and a box end tool joint (15). The tool joints have thickened cross sections in order to accommodate mechanical and hydraulic tools used to connect and disconnect the drill string. Drill pipe usually consists of a metal tube to which the pin end tool joint and the box end tool joint are welded. Similar tool joints are found on the other downhole components that make up a drill string. The tool joints may also have a smaller inside diameter (18), in order to achieve the thicker cross section, than the metal tube and, therefore, it is necessary to forge, or "upset", the ends of the tube in order to increase the tube's wall thickness prior to the attachment of the tool joints. The upset end portion (19) of the tube provides a transition region between the tube and the tool joint where there is a change in the inside diameter of the drill pipe. High torque threads (16) on the pin end and (17) on the box end provide for mechanical attachment of the downhole tool in the drill string. Another objective of this invention, therefore, is to provide a liner that will accommodate the varying diameters inside a drill pipe or other downhole component and not interfere with the make up of the drill string.

Figure 2:
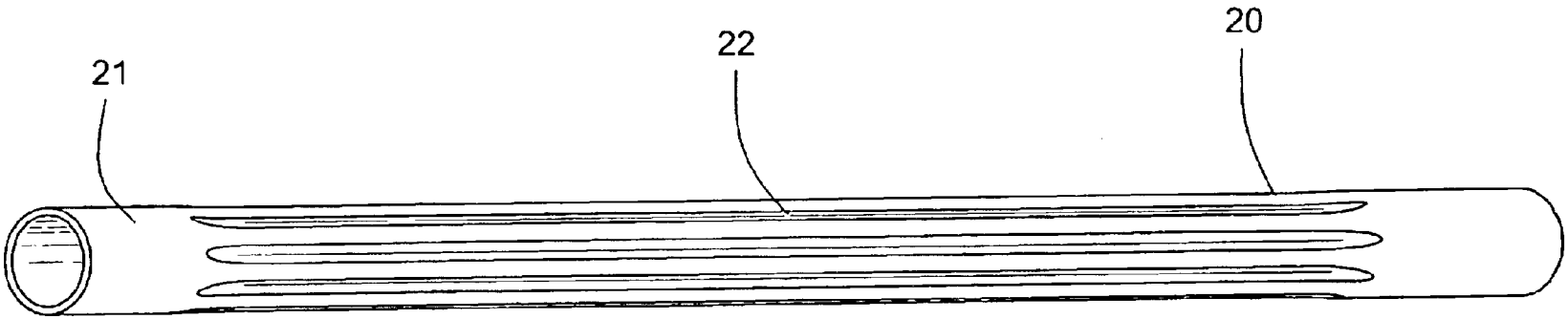
FIG. 2 is a perspective representation of a liner of the present invention having a convoluted non-uniform section along the length of the liner.

FIG. 2 is an illustration of a liner (20) of the present invention. It comprises a metal tube having uniform end portions (21) and a non-uniform section consisting of intermediate corrugations (22). In this figure, the corrugations extend longitudinally along the length of the tube, parallel to the axis of the tube. At the ends of each corrugation are transition regions that may generally correspond to the transitional regions within the upset drill pipe. The wall thickness of this liner may range from between about one half the wall thickness to greater than the thickness of the tube wall. Suitable metal materials for the liner may be selected from the group consisting of steel, stainless steel, aluminum, copper, titanium, nickel, molybdenum, and chromium, or compounds or alloys thereof. The liner is formed by providing a selected length of tubing having an outside diameter less than the desired finished diameter of the liner and drawing the tube through one or more dies in order to form the end portions and corrugations. The outside diameter of the liner may also be reduced during this process. Alternatively, the convolutions are formable by metal stamping, hydroforming, or progressive roll forming. In cases where the entry diameter of the tool joint is smaller than the inside diameter of the tube, the outside diameter of the tube may need to be decreased during the process of forming the end portions and corrugations, so that it can be inserted into a downhole component such as the drill pipe of FIG. 1,. Once the tube is inside the component, the tube is plugged and hydraulically or mechanically expanded to its desired diameter. The shape modification in the tube allow the tube to expand to at least its original outside diameter and beyond, if so desired, without excessively straining the material of the tube. In this fashion the tube can accommodate the changing inside diameter of the downhole component. Another method of expanding the tube is depicted in U.S. Pat. No. 2,263,714, incorporated herein by this reference, which discloses a method of drawing a mandrel through a lining tube in order to expand it against the wall of a pipe. Although the reference does not anticipate a varying inside diameter, the mandrel could be adapted, according to the present invention, to vary with the varying size of the tube within the downhole component.

Figure 3:
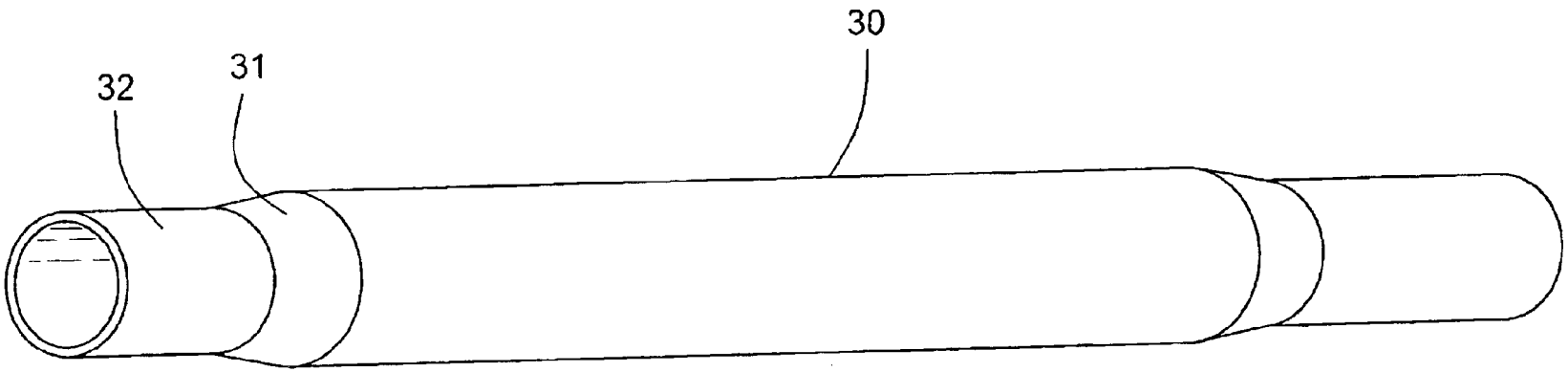
FIG. 3 is a perspective representation of an expanded liner of the present invention.

FIG. 3 is a representation of the expanded liner (30) of the present invention. For clarity the downhole component into which the liner has been expanded is not shown. The non-uniform section of the liner has been expanded to accommodate a downhole component having a changing diameter in the transition region (31) and a smaller inside diameter at end portions (32). For example, in order to provide a liner for an upset, 5⅞" double-shouldered drill pipe obtainable from Grant Prideco, Houston, Tex., having a tool joint inside diameter of approximately 4¼" and a tube inside diameter of approximately 5", a 316 stainless steel tube of approximately 33' in length and having a wall thickness of about 0.080" was obtained. The stainless steel ltube was drawn through a series of tungsten-carbide forming dies at Packless Metal Hose, Waco, Tex., in order to draw down the outside diameter of the tube to about 4.120". At the same time, the carbide dies formed the end portions and the corregations of the non-uniform section similar to those shown in FIG. 1. A tube similar to that shown at FIG. 1 was then inserted into the drill pipe, and the assembly was placed inside a suitable press constructed by the applicants. The end of the tube portions were sealed using hydraulic rams that were also capable of forcing pressurized water into the tube. Once the tube was completely filled with water, the pressure of the water was increased in order to expand the tube to match the inside diameter of the downhole tool, i.e. drill pipe. At around 150 psi the corrugations began to move or expand, as was evidenced by noises coming from inside the pipe as the corrugations buckled outward. The pressure was increased to between 3500 and 5000 psi whereupon the expansion noises nearly ceased. The applicants concluded that at about this time the liner was fully expanded against the inside wall of the pipe. Pressure inside the tube was then increased to above 10,000 psi whereby it is thought that the pipe expanded within its elastic limit, while the liner expanded beyond its plastic limit, thereby placing the liner in compression against the inside wall of the pipe after removal of pressure. When the pipe was removed from the press, visual inspection revealed that the liner had taken on the general shape as depicted in FIG. 3, and that the liner had been fully expanded against the inside diameter of the drill pipe. The applicant attempted to vibrate and remove the liner but found that it was fixed tightly inside the pipe.

Figure 4:
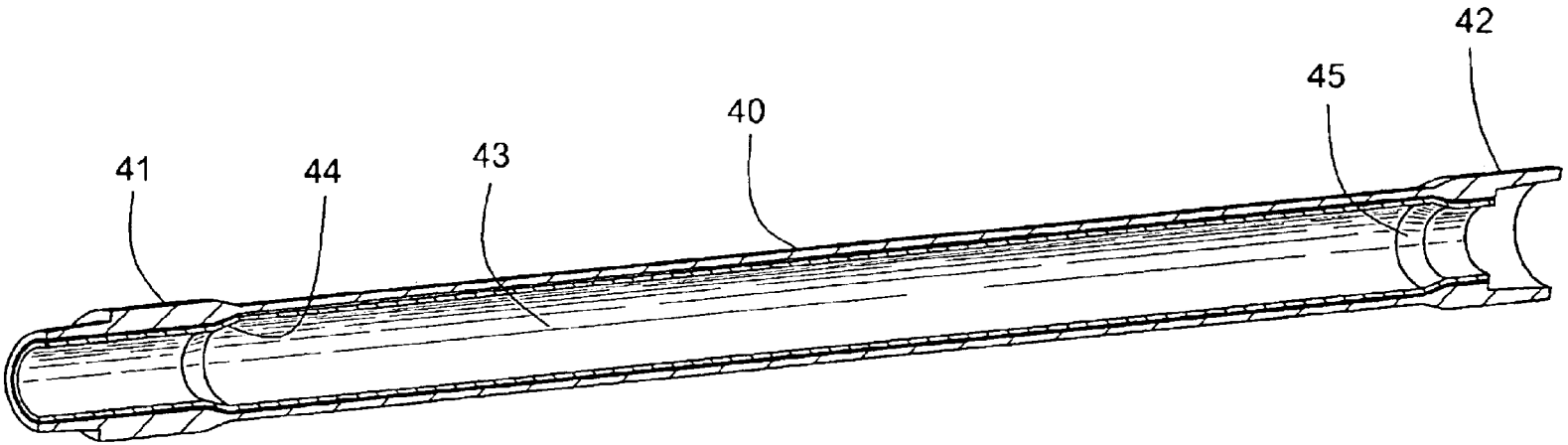
FIG. 4 is a sectioned perspective representation of a downhole tool having a liner.

FIG. 4 is an axial cross-section representation of a drill pipe (40) similar to that depicted in FIG. 1 with a liner (43) similar to that shown in FIG. 3. The thickened wall (41) of the pin end and the thickened wall (42) of the box end tool joints are depicted. The upset transition regions (44) at the pin end and (45) at the box end are also identified. For clarity, the liner (43) is shown not fully expanded against the inside wall of the drill pipe (40). However, as the liner is fully expanded against the inside wall of the downhole tool, the transition regions serve to lock the liner in place so that the liner is not only held in position by being in compression against the wall of the pipe, but is also locked in position by the changing inside diameter. A liner thus installed into a downhole tool has many advantages. Among these are the improvements of the hydraulic properties of the bore of the tool as well as corrosion and wear resistance.

Figure 5:
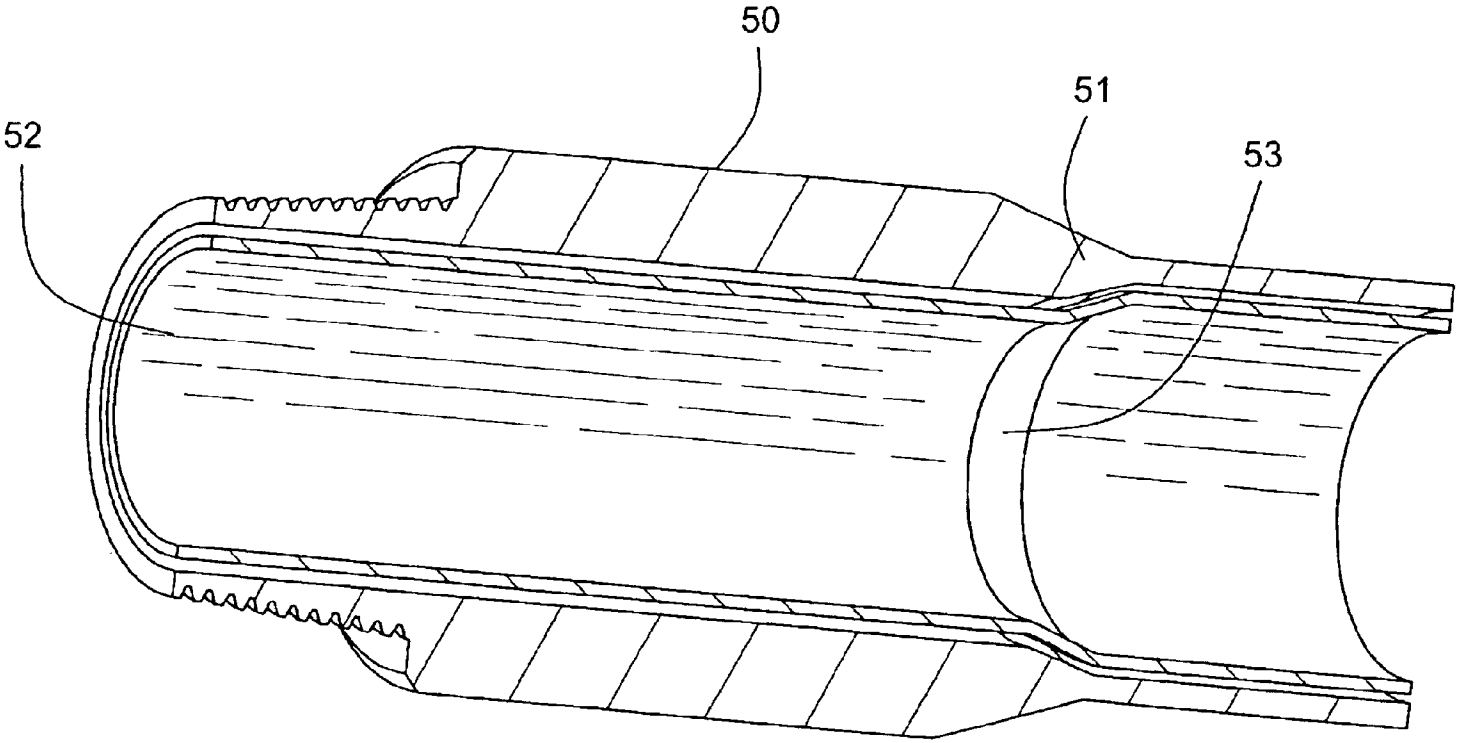
FIG. 5 is an enlarged sectioned perspective representation of the pin end of a downhole tool.

FIG. 5 is an enlarged representation of the pin end of FIG. 4. The thickened wall (50) of the tool joint is identified as well as the transition region (51) of the downhole tool. In the liner (52), the transition region (53) is depicted. Once again for clarity, the liner is depicted not fully expanded against the inside wall of the pipe. In actuality, at this stage of expansion, where the liner is not fully expanded, it is expected that the remains of the corrugations would still be visible. It is not expected that the corrugations would be fully ironed out until the tube is fully pressed against the tool wall. It will be noted that where differing materials are used, for example where the tool consists of 4100 series steel and the liner is a stainless steel, the intimate contact of the differing materials may induce a corrosive condition. In order to prevent galvanic corrosion, the liner or the tool, or both, may be coated with an electrically insulating material that would interrupt any galvanic current that might form when the liner and tool surface come in contact with each other in the presence of an electrolyte.

Figure 6:
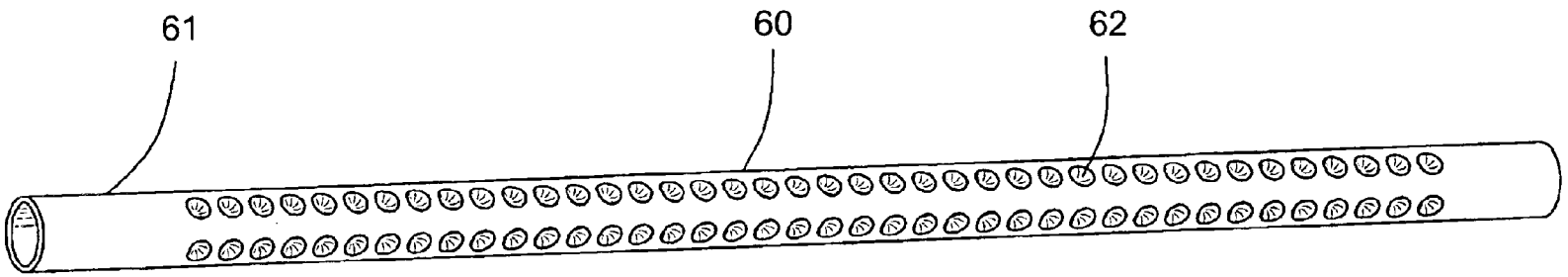
FIG. 6 is a perspective representation of a liner of the present invention having a dimpled non-uniform section.
Figure 7:
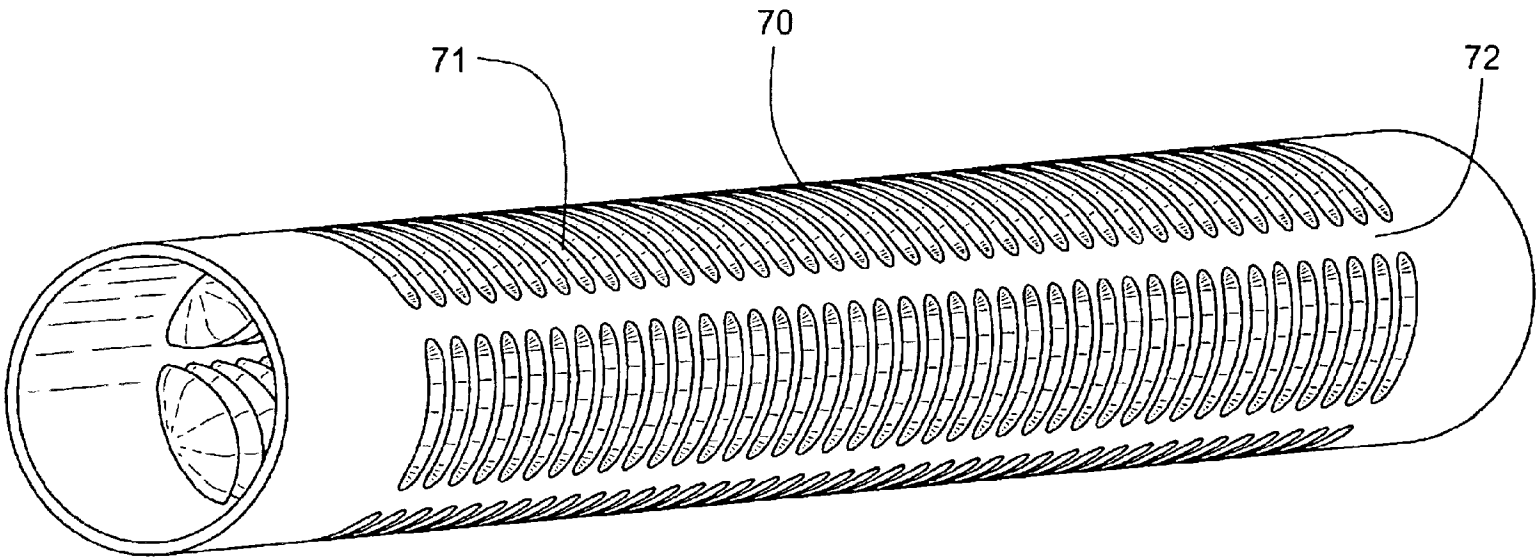
FIG. 7 is a perspective representation of a liner of the present invention having an ovoid non-uniform section.

FIG. 6 illustrates a liner (60) having end portions (61) and a non-uniform section of dimpled indentations (62) along the length of the tube. The dimples could be positive or negative with respect to the surface of the liner. As depicted the dimples are generally round in shape, but they could be ovoid or elongated as shown in FIG. 7, and the properties of FIG. 6 are applicable to the properties of FIG. 7, and vice versa, where the non-uniform section of the tube (70) has ovoid indentations (71). Although, the dimple pattern as shown is regular in both figures along the longitudinal axis of the tube, alternative patterns are possible and could be beneficial. For example, the pattern could be spiral or the pattern could consist of a combination of shapes alternating within the border region (72).

Figure 8:
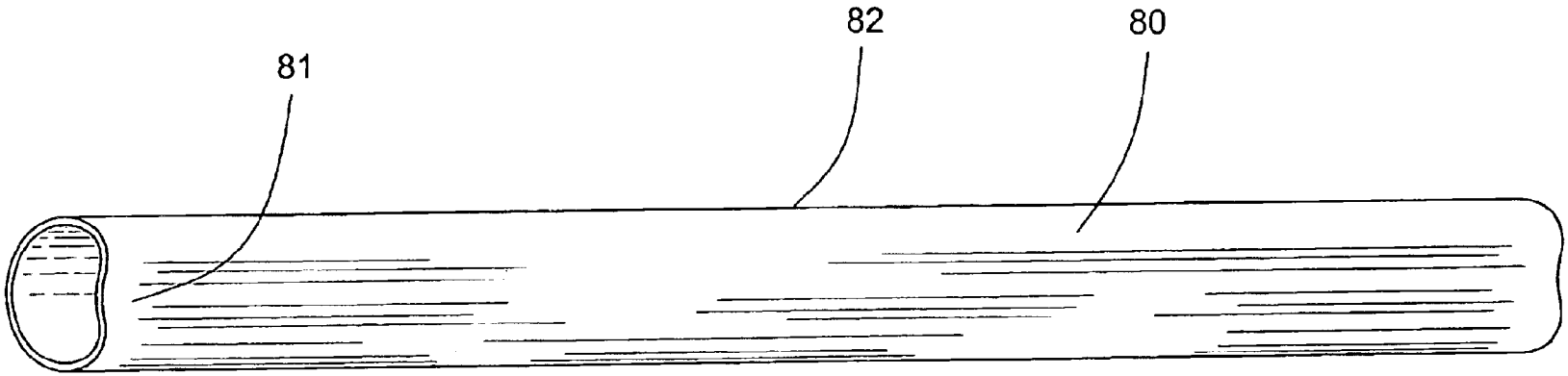
FIG. 8 is a perspective representation of a liner of the present invention having a concave non-uniform section.

FIG. 8 is a representation of another non-uniform section of the present invention provided in a tube. The deformation consists of a single corrugation (81) along the full lengthwise axis of the tube (80). Multiple corrugations are possible, but a single corrugation may be adequate. This design could also be used in connection with the regular end portions of FIG. 2. This modified "D" configuration is appealing for its simplicity in design, and yet it is capable of accommodating a downhole tool having a regular inside diameter. Tests by the applicants have shown that both thick and thin-walled tubing, having a thickness between about 0.010" and about 0.120" benefit from the non-uniform section of the present invention during expansion. Without the non-uniform section, finite-element analysis has shown that the liner will likely rupture before it is sufficiently expanded against the tool wall. The configuration depicted in FIG. 8 may be useful in situations where it is desired to place a conduit or conductor cable along the inside of the downhole tool. The corrugation would provide a pathway for the conduit and would form itself around the conduit during expansion. In this embodiment not only would the liner benefit the performance of the pipe, but it would also serve to fix the conduit or cable in place and protect it from the harsh downhole environment.

Figure 9:
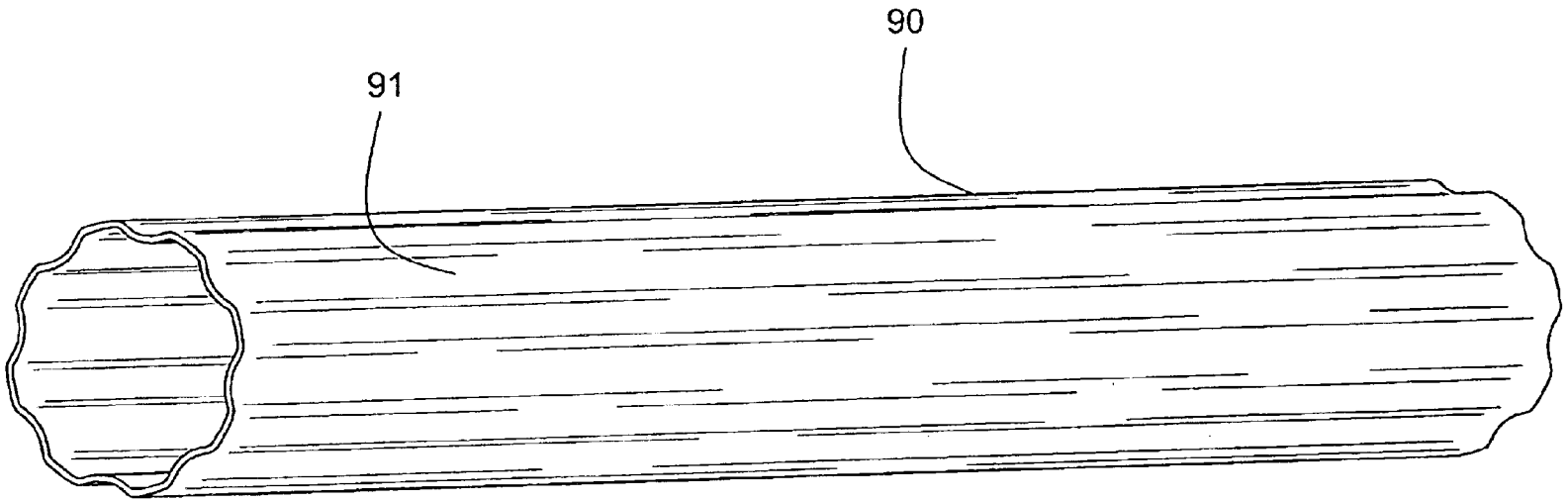
FIG. 9 is a perspective representation of a liner of the present invention having a corrugated non-uniform section.

FIG. 9 is a representation of a non-uniform section (91) provided in a tube (90). The non-uniform section consists of longitudinal corrugations that may or may not extend the full length of the tube. As depicted, the corrugations are at regular intervals around the circumference of the tube, however, the applicants believe that an irregular pattern may be desirable depending on the configuration of the inside wall against which the tube will be expanded. The desired depth of the corrugations as measured perpendicularly from the crest of the outer-most surface to the inside diameter as represented by the inner most surface of the trough may be determined by the total expansion required of the liner. For example, if the liner were to be installed into a downhole tool having a uniform inside diameter, the corrugations would not have to be as deep as the corrugations would need to be if the liner were to be installed into a tool having a varying inside diameter. For example, for a tool having a uniform inside diameter, the depth of the corrugations could be approximately equivalent to one half of the wall thickness of the tube prior to formation of the corrugations and be adequate to achieve sufficient expansion inside the tool, depending on the number of corrugations and their proximity to each other. On the other hand, where the inside wall of the tool has a varying diameter, the corrugations may have to exceed the greatest variation between inside diameter irregularities. These critical dimensions are best obtained for a given tool design by experimenting with the thickness and shape of the non-uniformities. The determination of optimum dimensions is included within the teachings of the liner of the present invention.

Figure 10:
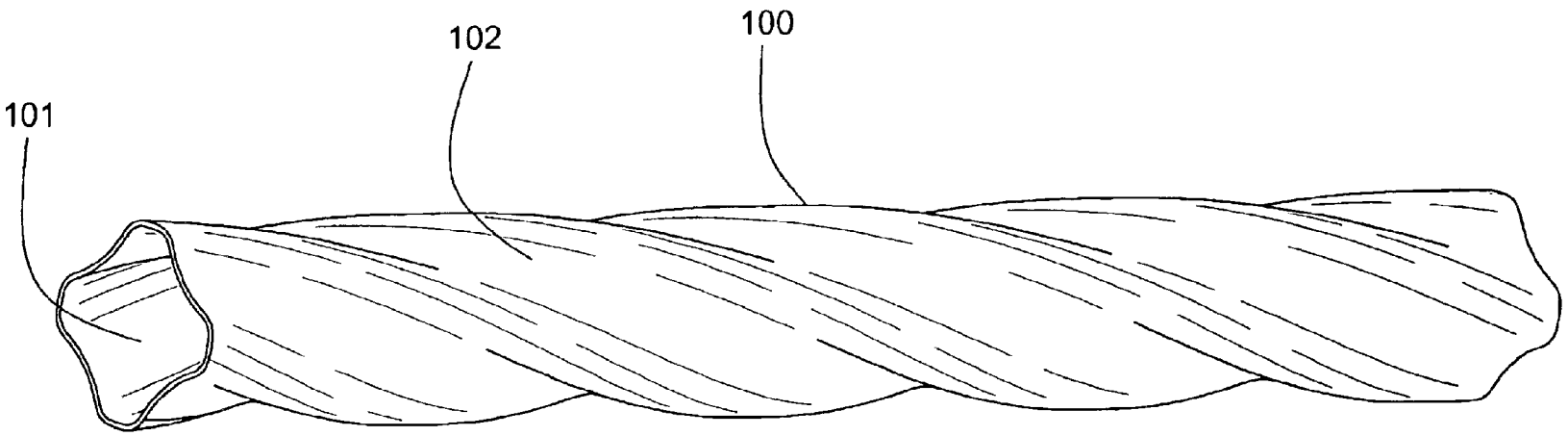
FIG. 10 is a perspective representation of a liner of the present invention having a spirally fluted non-uniform section.

FIG. 10 is a representation of the liner of FIG. 9 modified so that the liner (100) exhibits a non-uniform section along its length consisting of an inner wall (101) and an outer wall (102) made up of indentations that are formed into spiral flutes. This configuration would be useful in downhole tools having uniform inside wall surfaces. The flutes could be proportioned so that conduits and conductors could be disposed within the troughs and run along the full length of the downhole tool. Such conduits and conductors would then be protected from the harsh fluids and tools that are circulated through the tool's bore. In cases where it would be desirable to control the flow of fluid through the bore of the downhole tool, it may be desirable to expand the liner in such a manner so that the form of the indentations remain in the inside wall of the liner after it has been fully expanded. The modified flow produced by the presence of indentations in the inner wall of the downhole tool might be beneficial in reducing turbulence that tends to impede efficient flow of fluid through the tool.

Other and additional advantages of the present invention will become apparent to those skilled in the art and such advantages are incorporated in this disclosure. The figures presented in this disclosure are by way of illustration and are not intended to limit the scope of this disclosure.

What is claimed:

1. A downhole component comprising a deformable metallic tube and a conduit, the tube having a non-uniform section adapted for disposition within the downhole component, wherein the non-uniform section of the tube is expanded to substantially conform to an inside surface of the downhole component to form a liner, and wherein at least a portion of the conduit is intermediate the liner and the inside surface of the downhole component such that the liner provides a protective passageway for the conduit.

2. The downhole component of claim 1, wherein the tube is more corrosion resistant than the inside surface of the downhole component.

3. The downhole component of claim 1, wherein the tube is compressed against the inside surface of the downhole component.

4. The downhole component of claim 1, wherein the tube has a rough outside surface.

5. The downhole component of claim 1, wherein the tube is made of a material selected from the group consisting of steel, stainless steel, titanium, aluminum, copper, nickel, chrome, and molybdenum, and compounds, mixtures, and alloys thereof.

6. The downhole component of claim 1, wherein the tube has non-uniform material properties comprising a weld joint.

7. The downhole component of claim 1, wherein the non-uniform section of the tube has protrusions comprising convolutions, corrugations, flutes, or dimples.

8. The downhole component of claim 1, wherein the downhole component comprises a cylindrical wall having a thickness, and wherein the non-uniform section of the tube comprises protrusions with depths ranging from about one half the thickness of the wall to greater than the thickness of the wall.

9. The downhole component of claim 1, wherein the non-uniform section of the tube extends generally longitudinally of the length of the tube.

10. The downhole component of claim 1, wherein the non-uniform section of the tube extends spirally along the surface of the tube.

11. The downhole component of claim 1, wherein the non-uniform section of the tube is intermediate end portions of the tube.

12. The downhole component of claim 1, wherein the tube has a regular end portion that is free of the non-uniform section.

13. The downhole component of claim 1, wherein the downhole component is selected from the group consisting of drill pipe, heavy-weight drill pipe, casing, reamers, jars, shock absorbers, drill collars, bit boxes, electronic subs, bent subs, perforators, hydraulic motors, turbines, generators, pumps, down-hole assemblies, and batteries.

14. The downhole component of claim 1, wherein the tube is expanded conform to the inside surface of the downhole component using hydraulic pressure.

15. The downhole component of claim 1, wherein the tube is expanded inside the downhole component by being drawn over a mandrel.

16. The downhole component of claim 1, wherein one or more dies are used to form the non-uniform section of the tube.

17. The downhole component of claim 1, wherein the non-uniform section of the tube is formed using hydraulic pressure.

18. The downhole component of claim 1, wherein the non-uniform section of the tube is formed by roll forming or by stamping.

19. The downhole component of claim 1, wherein a portion of the tube is coated with an electrically insulating material.

* * * * *